United States Patent [19]

Vedvik et al.

[11] Patent Number: 4,597,704

[45] Date of Patent: Jul. 1, 1986

[54] STACK HANDLING METHOD AND APPARATUS

[75] Inventors: Andrew H. Vedvik, Poynette; Myron J. Merdler, Monona, both of Wis.

[73] Assignee: Oscar Mayer Foods Corporation, Madison, Wis.

[21] Appl. No.: 652,785

[22] Filed: Sep. 20, 1984

Related U.S. Application Data

[62] Division of Ser. No. 306,461, Sep. 28, 1981, Pat. No. 4,478,024.

[51] Int. Cl.[4] ..... B65H 31/40

[52] U.S. Cl. ..... 414/28; 198/434; 198/740; 414/89; 414/786

[58] Field of Search ..... 414/28, 29, 89, 786; 53/446, 447, 473, 532, 540, 544; 198/422, 423, 434, 487, 740; 271/151, 245, 246

[56] References Cited

U.S. PATENT DOCUMENTS

| | | | |
|---|---|---|---|
| 2,708,863 | 5/1955 | Payne | 414/29 X |
| 3,225,684 | 12/1965 | Smith | 414/28 X |
| 3,453,167 | 7/1969 | Arvidson et al. | 198/487 X |
| 3,638,538 | 2/1971 | Sullivan | 198/422 |
| 3,655,078 | 4/1972 | Androkitis | 414/28 |
| 3,915,316 | 10/1975 | Pomara | 414/35 |
| 3,964,598 | 6/1976 | Alsop | 198/434 X |
| 4,178,118 | 12/1979 | Bailey | 414/28 |
| 4,341,299 | 7/1982 | Walker et al. | 414/28 X |
| 4,389,148 | 6/1983 | Lorenz | 414/89 X |

*Primary Examiner*—Leslie J. Paperner

*Attorney, Agent, or Firm*—Joseph T. Harcarik; Thomas R. Savoie; Daniel J. Donovan

[57] ABSTRACT

A method and apparatus are disclosed for aligning the slices in stacks of sliced food products and for loading the stacks into container cavities. Stacks are received sequentially from a supply conveyor onto a stack support surface, where the stacks are detained either by friction with the support surface or by a stack catcher. A stack positioning member movable along the support surface pushes the stacks into engagement with a stack former for aligning the slices. Simultaneously, the stack positioning member retards movement of the next upstream stack on the supply conveyor so that the stack comes to rest on the support surface, and then pushes the previously aligned stack to a downstream pick-up station for loading into a container cavity. Each stack is removed from the loading station by a gripper assembly which pivots between the loading station and the container. Each gripper assembly has a plurality of pick-up fingers which may be spread to receive a stack at the loading station or to release the stack into a container. Each gripper assembly may also include a plurality of guide fingers of greater length than the pick-up fingers to extend downwardly and guide the stack into the container cavity. The pick-up and guide fingers are controlled by a rotary cam plate which engages the upper ends of the pivotally mounted fingers and, by incremental rotation, selectively spreads or closes the fingers.

26 Claims, 30 Drawing Figures

38
40
42
36

5
3
44
4
4e
4d
4c
4b
4a
2
12
6
7
206
5
3
4

124
126
128
46
72
196
48
54
214
52
4e
6
10
8
4d
4c
16
10
4b
24
4a
18
214
80
14
12
196
48
192
190
108
126
128
104
124
14
14

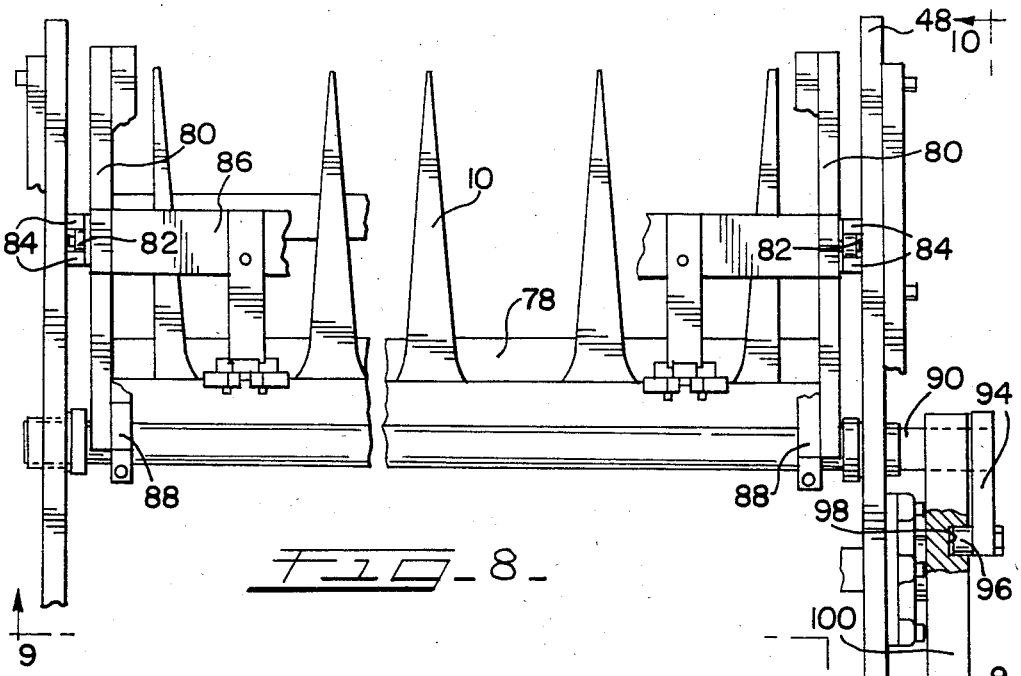
FIG. 8
FIG. 9
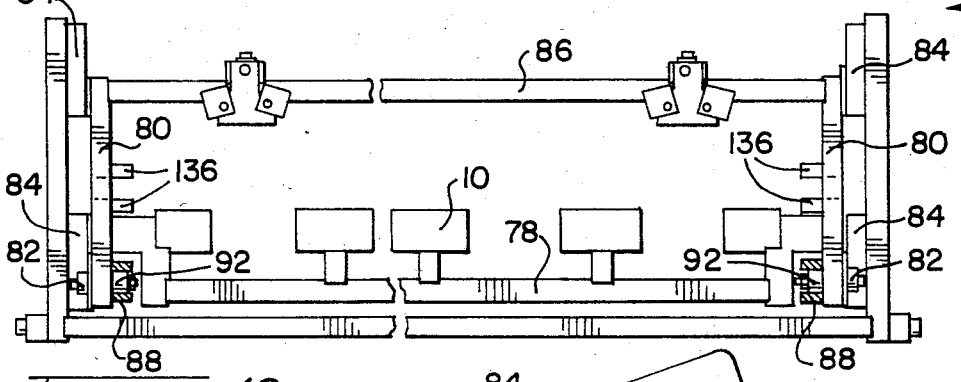
FIG. 10
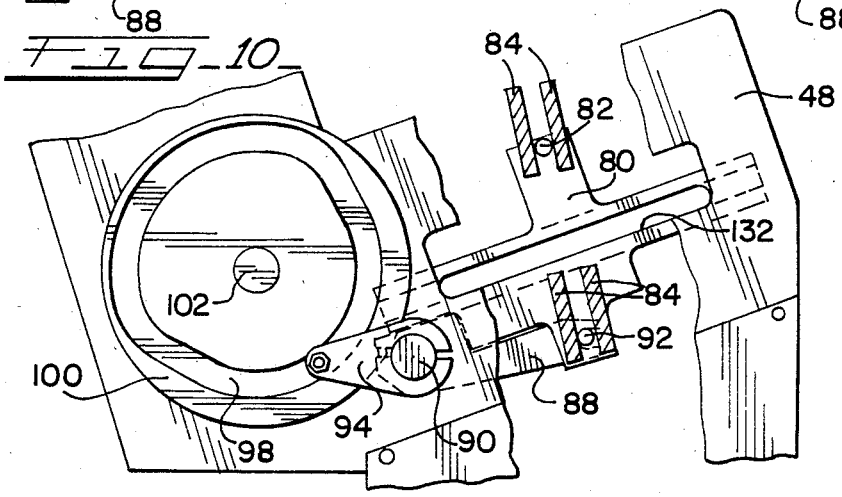

FIG. 19
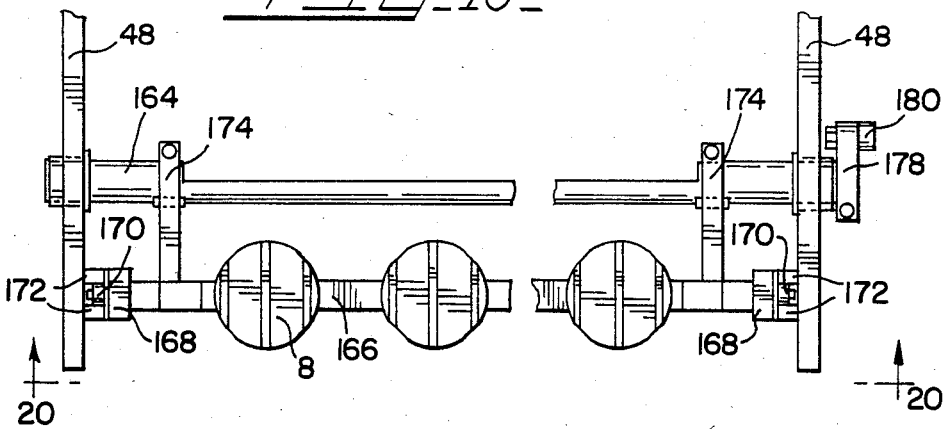
FIG. 20
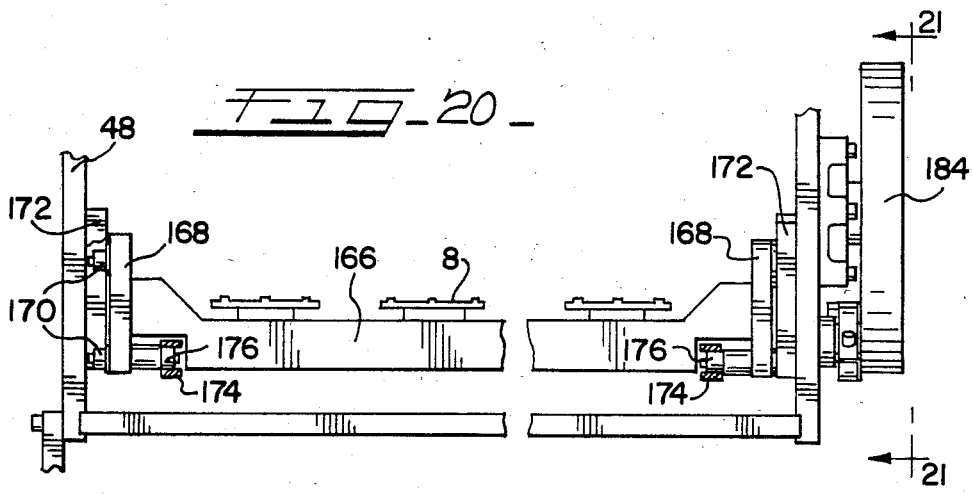
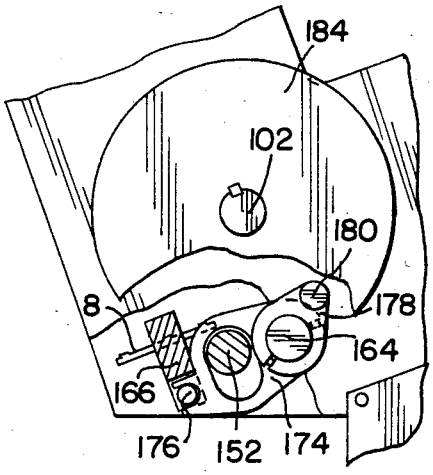
FIG. 21

STACK HANDLING METHOD AND APPARATUS

This is a division, of application Ser. No. 306,461, filed Sept. 28, 1981, now U.S. Pat. No. 4,478,024.

The present invention is generally directed to a method and apparatus for handling stacks of sliced food products, such as stacks of sliced sausage products (bologna, salami, summer sausage, other types of luncheon meat, etc.). More particularly, the present invention is directed to a method and apparatus for aligning the slices within each stack and depositing the stacks into container cavities.

For purposes of illustrating a specific embodiment, this invention will be described with reference to sliced luncheon meat.

Certain operations during the packaging of sliced luncheon meat have previously been manual operations. Typically, the slices are cut from a large frozen loaf or sausage "stick" by a high speed rotary slicer which discharges the slices in loosely arranged stacks of the appropriate weight. The slices of each stack are then manually arranged into vertical alignment for insertion into snug or close fitting cavities in a rigid plastic tray, which is later covered and sealed to provide the finished package.

Although such manual operations are generally satisfactory, there is a continuing need and desire to automate such operations to reduce product cost and to improve productivity, product uniformity and quality control.

Accordingly, an object of the present invention is to provide a method and apparatus for forming the slices in stacks of sausage products into vertical alignment for depositing the stacks into container cavities.

A further object of the present invention is to provide a method and apparatus for performing such operations on a plurality of stacks simultaneously, without damaging the slices in each stack.

These and other objects will become apparent from the following detailed description of this invention.

These and other objects of the present invention are achieved by providing a stack support surface, preferably downwardly sloping, which is positioned to receive stacks sequentially from an upstream supply conveyor. Each stack is briefly detained on an upstream end of the support surface, either by friction between the stack and the support surface or by a movable stack-engaging catcher. A stack positioning member is provided which is movable along the support surface to engage a rearward edge of the detained stack and push the stack into engagement against a downstream stack former which is shaped to urge any misaligned slices into alignment. Simultaneously with pushing a previously detained stack against the stack former, the stack positioning member retards movement of the next-most upstream stack on the supply conveyor so that the stack comes to rest on the upstream end of the support surface.

During its next pass along the support surface, the stack positioning member pushes the aligned stack past the stack former to a stack loading position further downstream. To permit this movement of the aligned stack, the stack former is momentarily moved to a stack release position. Immediately after passage of the aligned stack, the stack former returns to the stack-engaging position to engage the next upstream stack being pushed forward by the stack positioning member during that same pass.

Thus, in the preferred embodiment, the stack positioning member performs operations on three in-line stacks simultaneously during each pass along the conveyor surface: (1) retards movement of the upstream-most stack on the supply conveyor so that the stack comes to rest on the upstream end of the support surface; (2) pushes a stack previously detailed on the support surface into engagement with a stack former to align the slices; and (3) pushes the previously aligned stack to the next downstream position for loading into the container cavity of the food package.

In the present invention, a plurality of rows of in-line stacks may be provided side-by-side so that these operations may be performed simultaneously on several (e.g., up to five) rows of in-line stacks.

In accordance with further aspects of the present invention, a stack gripper assembly is provided for picking up an aligned stack from the loading station and depositing the stack into a closefitting container cavity. The gripper assembly is pivotally mounted to swing between the loading station and the container, and has a plurality of depending pick-up fingers which may be selectively spread or closed to receive and hold a stack at the loading station and to release the stack into a container cavity. The gripper assembly may include at least a pair of depending guide fingers which are longer than the pick-up fingers so that the guide fingers can extend at least partially into the container cavity, to guide the stack into the cavity when the stack is released by the pick-up fingers. Preferably, each of the pick-up and guide fingers is pivotally mounted between the finger ends, with the upper end being operable by a cam to selectively spread or close the lower, stack-engaging portion of the fingers.

These and other aspects and objects of the present invention are shown in the following detailed description of the preferred embodiment of the present invention as shown in the attached drawings, of which:

FIG. 8 is a vertical plan view of the stack catcher assembly which is employed in the present invention to detain a stack on the upper end of the stack support surface.

FIG. 9 is an end view of the stack catcher assembly of FIG. 8 taken along line 9—9 of FIG. 8.

FIG. 10 is a side elevational view taken along line 10—10 of FIG. 8, with portions broken away to better depict the means by which the catcher is raised into a stack engaging position or lowered to a stack release position.

FIG. 19 is a top plan view depicting pedestals of the present invention upon which the stacks rest at the loading station.

FIG. 20 is an end view taken along line 20—20 of FIG. 19.

FIG. 21 is a side elevational view taken along line 21—21 of FIG. 20, with portions broken away to better depict the means by which the pedestals are raised and lowered.

Figure 1:
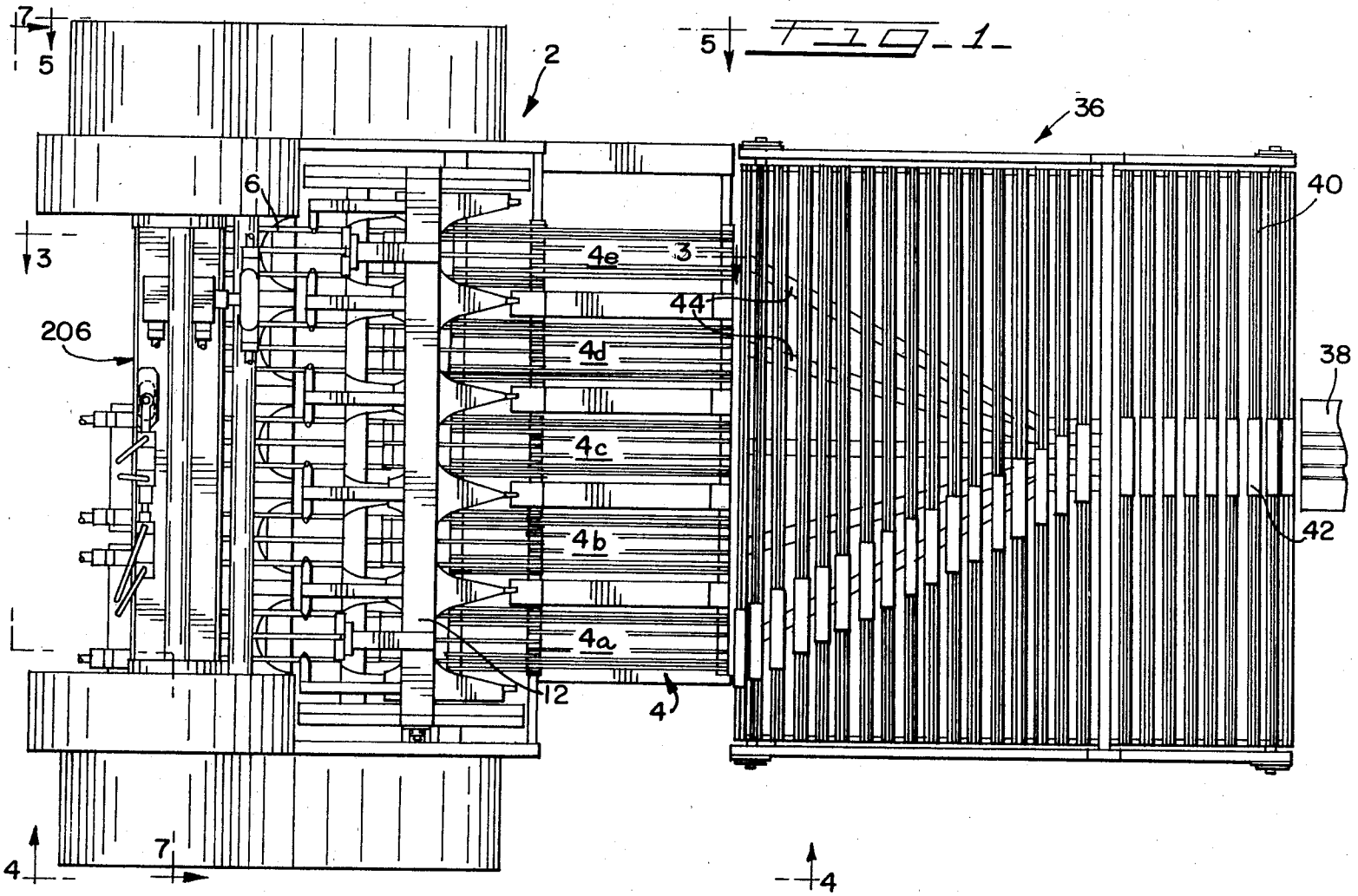
FIG. 1 is a top plan view of an apparatus for aligning slices within a plurality of stacks of sliced luncheon meat and for depositing the stacks into close-fitting container cavities.

FIGS. 26*a*–26*e* diagramatically depict the sequence of operations of the stack aligning and loading apparatus shown in FIG. 1.

As shown in FIG. 1, the apparatus embodying the present invention, generally designated by the numeral 2, is located at the downstream end of stack supply conveyor 4 for receiving stacks of sliced luncheon meat. In accordance with the present invention, referring briefly to FIGS. 2–3, a stack support surface is defined by a plurality of downwardly inclined slide rails 6 which extend between the upstream stack supply conveyor 4 and a stack loading station characterized by movable stack support pedestals 8.

In the illustrated embodiment, the apparatus 2 performs the operations simultaneously on five rows of in-line stacks. However, for clarity, the following description may focus on the operations with respect to a single stack or a single row of in-line stacks.

Stacks discharged onto the slide rails from the supply conveyor are initially detained on the upper end of the conveyor either by friction between the stack and the rails or by engagement between a pair of elongated tapered guides 10 which form a stack catcher to block further movement downstream. Retraction of the guides 10 to a position below the slide rails 6 releases the stack for movement further downstream along the rails.

To control movement of stacks between the upstream supply conveyor 4 and the pedestal 8, and to cause alignment of any misaligned slices within each stack, a stack positioning member 12 is mounted for reciprocating movement parallel to the slide rails 6. During movement of the positioning member toward the pedestal 8, pusher surface 14 engages a rearward edge of the detained stack and pushes the stack into engagement with a downstream stack former 16 which is shaped to urge any misaligned slices of the stack into alignment. Simultaneously, the stack positioning member, via upstream facing surface 18, engages the front edge of the next-most upstream stack on the faster moving supply conveyor to retard that stack's movement onto the slide rails so that the stack comes to rest on the upstream end of the conveyor.

The stack former 16 is also movable to a retracted position below the slide rails 6 to permit an aligned stack to pass onto one of the pedestals 8 from which the stack is loaded into a close fitting cavity 20 in a container 22, such as a rigid plastic tray container. To move the aligned stack onto the pedestals, the stack positioning member 12 has a pair of depending stack-engaging pins 24 positioned forwardly of the pusher surface 14. The stack former is retracted momentarily so that the aligned stack can be pushed forward and then immediately returns to a stack-engaging position to engage the stack being pushed forward by the pusher surface 14.

Figure 23:
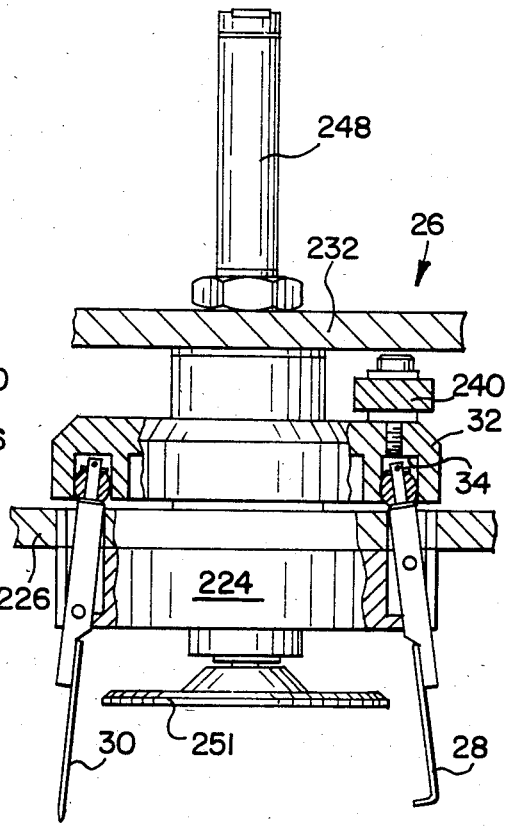
FIG. 23 is an elevational view, partially in section, of one of the gripper assemblies, depicting the pick-up and guide fingers in the spread position for receiving a stack.
Figure 24:
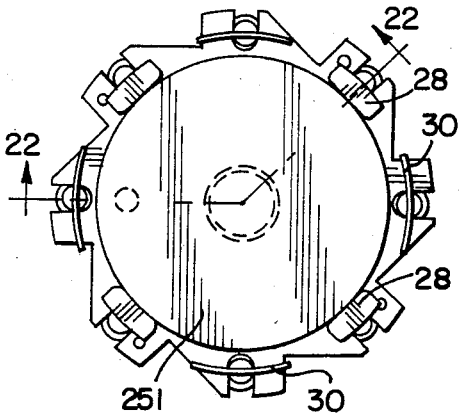
FIG. 24 is a bottom plan view of the gripper assembly depicted in FIG. 22.
Figure 25:
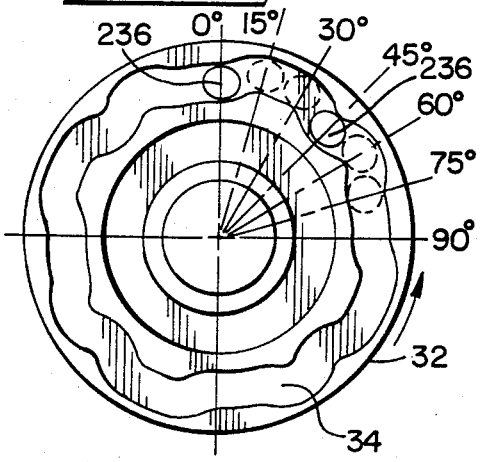
FIG. 25 is a bottom plan view of a cam plate employed in the gripper assembly of FIGS. 22 and 23 for spreading and closing pick-up and guide fingers.

An aligned stack is deposited into the close fitting container cavity 20, by a stack gripper assembly 26 which is pivotally mounted to swing between the pedestals 8 and the container 22. The gripper assembly has at least a pair of depending pick-up fingers 28 which may be selectively spread (FIG. 23) or closed to receive a stack at the loading station pedestal 8 and to deposit the stack into the cavity 20. The gripper assembly may also include a pair of guide fingers 30, which are longer than the pick-up fingers so as to extend at least partially into the close-fitting cavity 20, to guide a stack into the cavity when the stack is released by the pick-up fingers.

Selective opening and closing of the pick-up and guide fingers 28 and 30 are controlled by a rotary cam plate 32. Each finger is pivotally mounted at a midpoint, and at the upper end extends into a cam track 34 in the underside of the cam plate 32. Incremental rotation of the cam plate selectively opens both pick-up and guide fingers so as to receive a stack from pedestal 8, closes both pick-up and guide fingers to retain the stack, and opens the pick-up fingers while leaving the guide fingers closed to deposit the stack into container cavity 20.

Having briefly described various features of the present invention, the following is a more detailed description of the apparatus and mode of operation of the present invention. Returning to FIG. 1, the supply conveyor 4 preferably has several conveyor runs (4*a*–4*e*) for supplying stacks to the apparatus 2. Because the container 22 into which the stacks are loaded is available with rows of five cavities, the present invention is depicted for performing operations on five stacks simultaneously. Accordingly, the supply conveyor 4 has five conveyor runs for supplying stacks to the apparatus 2. The supply conveyor receives the stacks from an upstream diverting conveyor 36. The diverting conveyor receives the stacks from an upstream supply source, such as a slicer.

The diverting conveyor 36 has an endless conveyor surface made up of a series of pairs or rods 40 which are attached to links in drive chains on each side of the conveyor. A relatively narrow sleeve 42 is slidably mounted on each pair of rods, and has a follower (not shown) on the underside for traveling within one of five diverging guides 44 mounted beneath the diverting conveyor surface. A diverter (not shown) is located approximately in the center of the conveyor, where the guides 44 meet. The diverter channels the follower of each sleeve into one of the five guides, to provide stacks of luncheon meat sequentially to each of the five conveyor runs of the supply conveyor 4. Preferably, the sequential delivery is from one side of the supply conveyor to the other and then from the other, back to the first. For example, beginning at conveyor run 4a, ten stacks would be sequentially channeled onto the conveyor runs in the order of 4a to 4e and then in the order **4*e* to 4*a***.

The apparatus is free standing with respect to the diverting conveyor 36, and has a support frame 46 which includes a pair of rigid upright side plates 48 and an inclined base plate 50 extending between the side plates. The support frame carries the various parts of the present invention, including the supply conveyor 4 which extends between the diverting conveyor and the slide rails 6.

Figure 3:
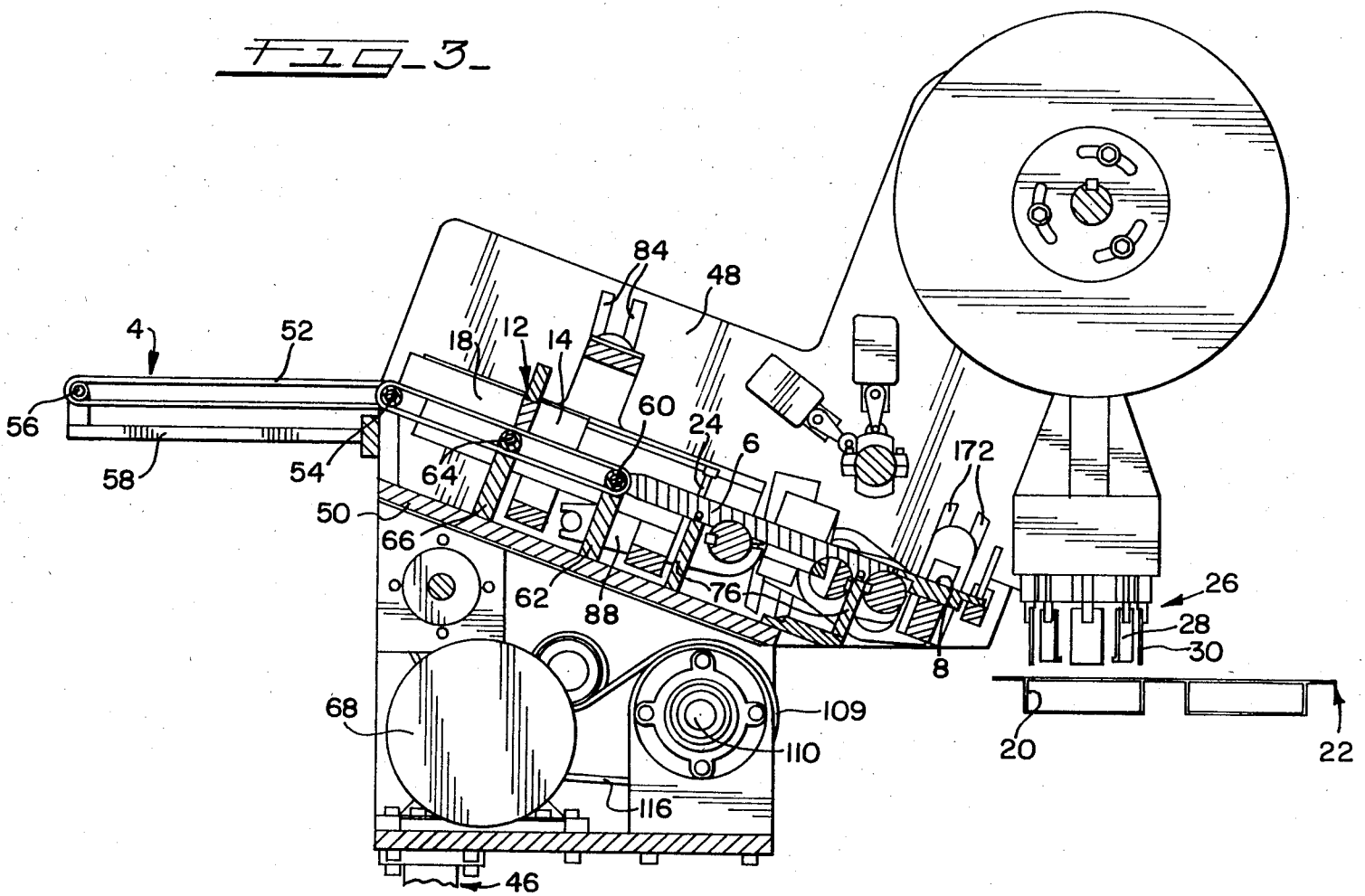
FIG. 3 is a vertical cross-sectional view of the apparatus of FIG. 1 taken along line 3—3 of FIG. 1.

As best seen in FIG. 3, the supply conveyor 4 has a horizontal upstream portion onto which the stacks are received from the diverting conveyor 36 and an inclined downstream portion which is located between the side plats. The downstream portion is substantially coplanar with the top edges of the slide rails 6 for discharging stacks onto the conveyor. The horizontal portion of the supply conveyor is defined by endless elastic bands 52 which extend between a horizontal rotary drive shaft 54 and a freely rotating shaft 56 mounted on the end of cantilever arms 58. The arms extend from the frame 48 to adjacent the downstream end of the diverting conveyor 36.

As noted earlier, the conveyor bands 52 are spaced apart sufficiently to define five discrete conveyor runs **4*a*–4*e* for feeding stacks in rows of five into apparatus 2**. Each run has a plurality of conveyor bands, preferably from six to eight. The bands may be made of a plastic material, such as polyurethane, which is easy to clean and approved for contact with food products. The bands are also preferably circular in cross-sectional shape to minimize contact and friction with the underside of each stack.

Figure 2:
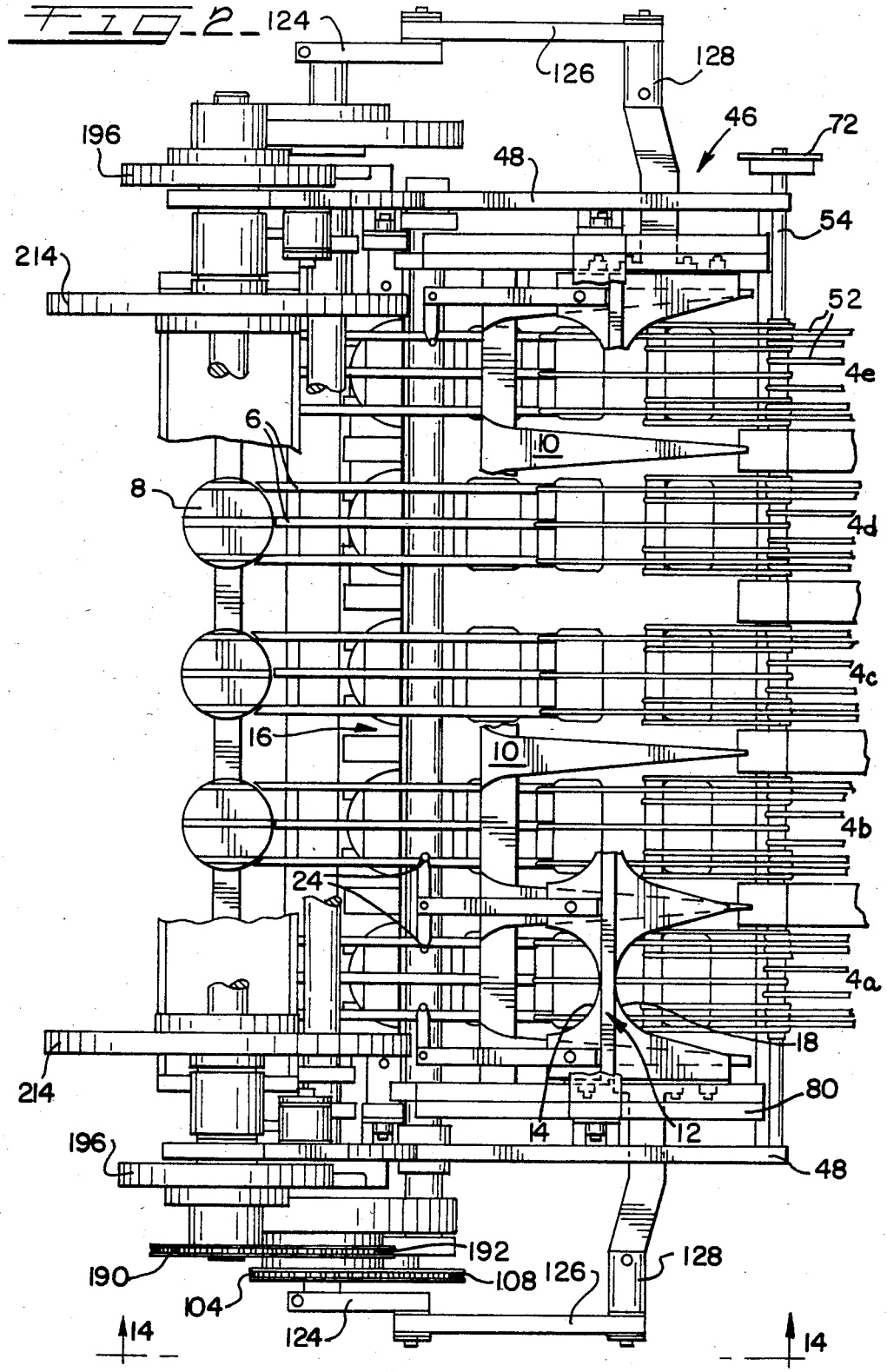
FIG. 2 is a top plan view of that part of the apparatus of FIG. 1 for aligning slices within stacks, with portions of overlapping elements removed to better illustrate the construction.

Each run **4*a*–4*e* of the downwardly inclined portion of the supply conveyor 4 extends between the rotary drive shaft 54 on the upstream end and a freely rotable shaft 60 mounted atop a support bracket 62 carried by base plate 50. As best seen in FIG. 2, only three of the conveyor bands 52 of the inclined portion extend fully between shafts 54 and 60, and these three are aligned with three slide rails 6 onto which each stack is discharged from the conveyor. With only three bands, there is a reduced force to drive stacks on the slide rails 6, thereby permitting the stack to come to rest on the upper end of the slide rails by reason of the friction of slide rails 6 exceeding the driving force of the bands 52. During normal operation, a stack will typically rest partially on the rails and partially on the conveyor 4, with the three continuously moving conveyor bands 52 sliding beneath the stack. The other bands which make up the inclined conveyor portion of each run, extend only from the drive shaft 54 to a freely rotating intermediate shaft 64 which is also mounted atop an upstanding support bracket 66 (FIG. 3**).

Figure 4:
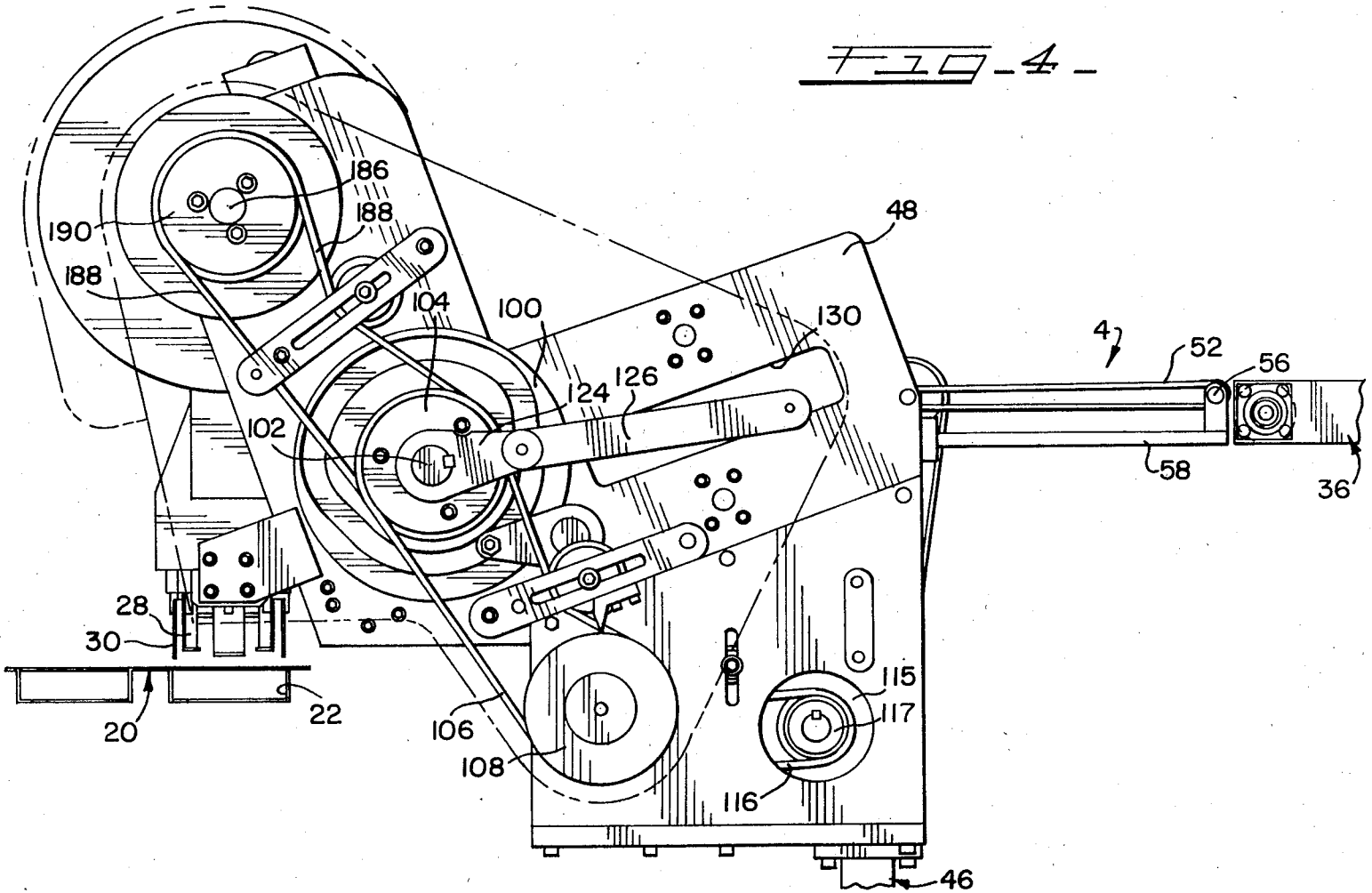
FIG. 4 is a side elevational view of the apparatus of FIG. 1, taken along line 4—4 of FIG. 1, with the safety shield (depicted by dashed lines) removed.
Figure 5:
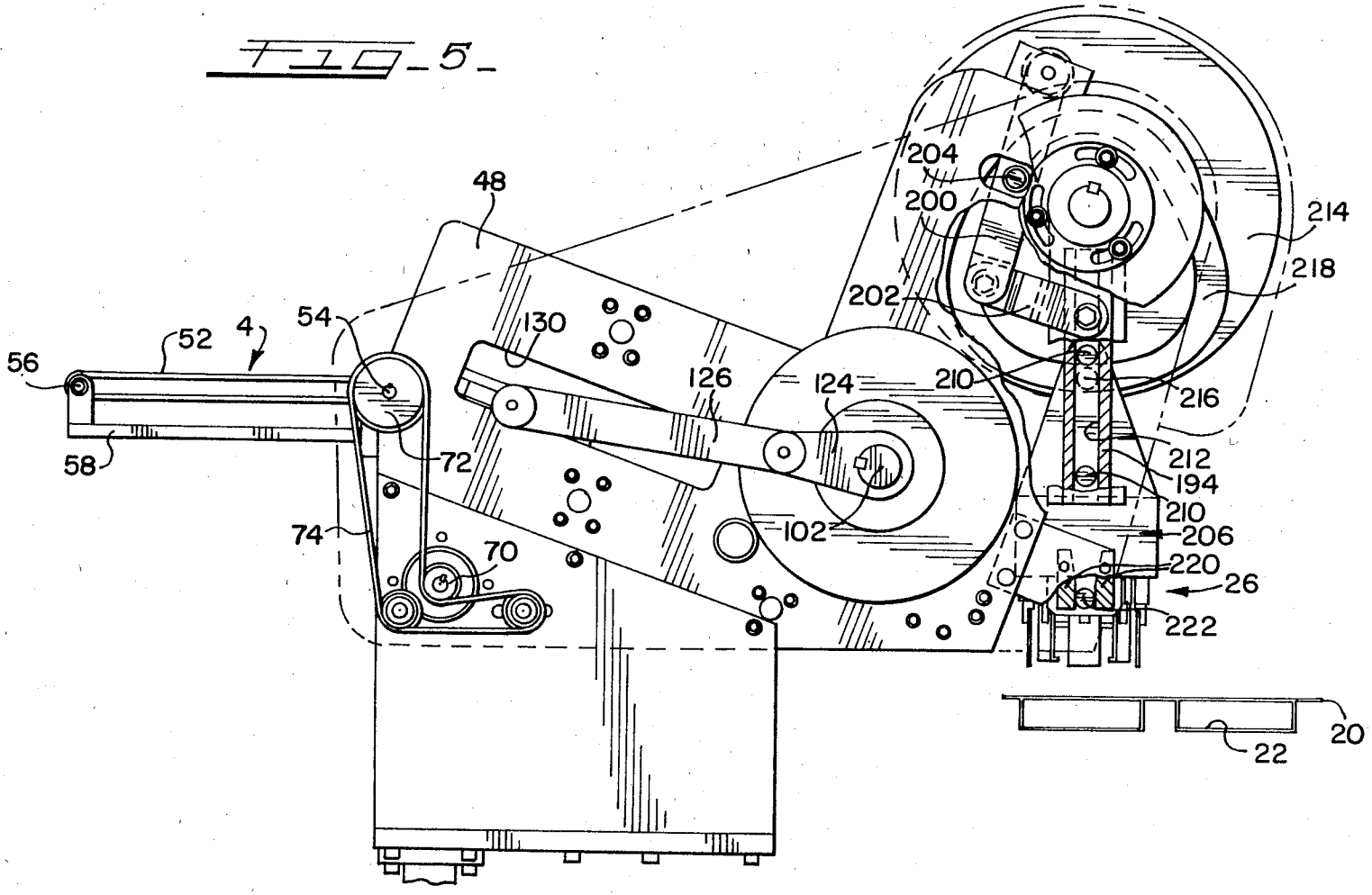
FIG. 5 is a side elevational view of the opposite side of the apparatus of FIG. 1, taken along lines 5—5 of FIG. 1, with the safety shield removed, and with portions of the apparatus also broken away to better depict the means for pivoting the gripper assembly between the load pick-up position and the container.

The drive shaft 54 for the upstream conveyor 4 is rotated by an electric motor 68 mounted in a compartment below the base plate 50. Referring to FIGS. 3–5, the motor 68 is connected to pulley or sprocket 70 which drives a pulley or sprocket 72 on the end of the rotary drive shaft 54 via belt or chain 74. The upstream conveyor 4 is preferably run continuously, and the low friction between the bands 52, which are cross-sectionally circular, and the stacks permits the bands to slide easily beneath the stacks if the stacks are blocked against further movement.

As described briefly above, and best seen in FIGS. 2–3, three spaced slide rails 6 define the stack support surface for each of the five stack runs. The three rails extend between the end of supply conveyor 4 and the respective pedestal 8 for that particular run. Each rail is colinear with one of the three conveyor bands 52 forming the downstream end of the supply conveyor. The top (stack carrying) surfaces of the rails are generally co-planar with the conveyor bands 52, so that stacks slide readily onto the support surface defined by the top edge of the rails.

The slide rails 6 are fixedly mounted atop supports 76 upstanding from the base plate 50. The rails are preferably made of a dense, rigid plastic, such as polyethylene, although other materials (e.g., stainless steel) can be used which are appropriate for contact with food products and easy to clean.

During continuous operation of the apparatus 2, friction between the slide rails 6 and the stacks will normally bring the stack to rest on the upstream end portion of the slide rails, usually partially overlapping the slide rails and the end of the supply conveyor 4. However, to prevent the stacks from inadvertently sliding further along the rails and interfering with other operations of the apparatus, a stack catcher is provided for each run in the form of a pair of elongated tapered guides 10, which are movable between a position below the slide rails 6 to permit a stack to pass and a raised position to block movement of a stack.

FIGS. 8–10 depict the construction of the guides 10 and the apparatus for moving the guides between raised and lowered positions. The guides 10 are preferably made of rigid, food-grade plastic and are fixedly mounted atop a cross bar 78 which extends between a pair of slide lifters 80. The slide lifters move the guides between a raised, stack catching position above the slide rails 6, and a lowered, stack release position below the slide rails. Each guide 10 is positioned along the cross bar 78 so that the guide is raised and lowered between each set of three slide rails forming a stack run. The elongated tapered ends of the guides are sufficiently long to extend upstream between each run 4a-e of the supply conveyor 4, almost the entire length of the inclined portion. At the narrow, pointed end, adjacent pairs of guides are spaced sufficiently far apart to receive a non-aligned stack. However, at the wider end, the guides are sufficiently close to prevent passage of a stack.

In the illustrated embodiment, which is intended to align and load stacks of luncheon meat up of circular or round slices, the wider ends of the guides 10 are also curved slightly (FIGS. 2 and 8) to nestingly receive or engage such stacks, and to aid in urging misaligned slices into alignment.

The guides 10 are lifted or lowered by slide lifters 80 attached to opposite ends of the cross bar 78. Each slide lifter has a pair of followers or pins 82 slidably positioned in vertical slots defined between wear strips 84 mounted to the inside surface of the side plates 48. An upper crossmember or brace 86 extends between the lifters to keep the lifters spaced apart and prevent excessive play, which might allow pins or followers 82 to escape from between the wear strips 84.

Each slide lifter 80 is raised and lowered by a lever 88 which is attached to a common pivot shaft 90 which extends between the side plates 48. Each lever is slotted at the end (best seen in FIG. 10) to receive a pin 92 attached to the slide lifter. The shaft 90 is pivoted to raise or lower the slide lifters and the guides by pivot arm 94 which is attached at one end to the pivot shaft 90 and has a cam follower 96 at the other end. The cam follower 96 resides within a cam track 98 of rotary cam plate 100. As the cam plate 100 rotates, the cam track forces the pivot arm to turn the shaft 90 which moves the levers 88 accordingly, thereby raising or lowering the slide lifters 80 and the guides 10.

Referring back to FIGS. 3 and 4, cam plate 100 is mounted on a master drive shaft 102 which directly or indirectly drives most of the apparatus of the present invention for aligning slices within the stacks. The drive shaft 102 also mounts a sprocket 104 which is connected via chain 106 to the output drive sprocket 108 of the single revolution electric cluch shaft 110 (FIG. 3). The gear reducer 115 is driven by the same electric motor 68 which drives the supply conveyor 4. The sprockets 104 and 108 preferably have the same number of teeth and are of the same diameter, so that one rotation sprocket 108 results in one complete rotation of sprocket 104 and shaft 102.

The gear reducer 115 is directly coupled to the drive motor 68 (which is constantly running). The gear reducer 115 drives the constantly turning input sprocket 109 of the single revolution electric clutch shaft 110 by means of the chain 116 and reducer output sprocket 117.

The single revolution electric cluch shaft 110 makes one revolution only after all five channels have been filled in the proper sequence. Therefore, the apparatus waits for the slicer to produce 5 stacks of product before cycling.

Figure 11:
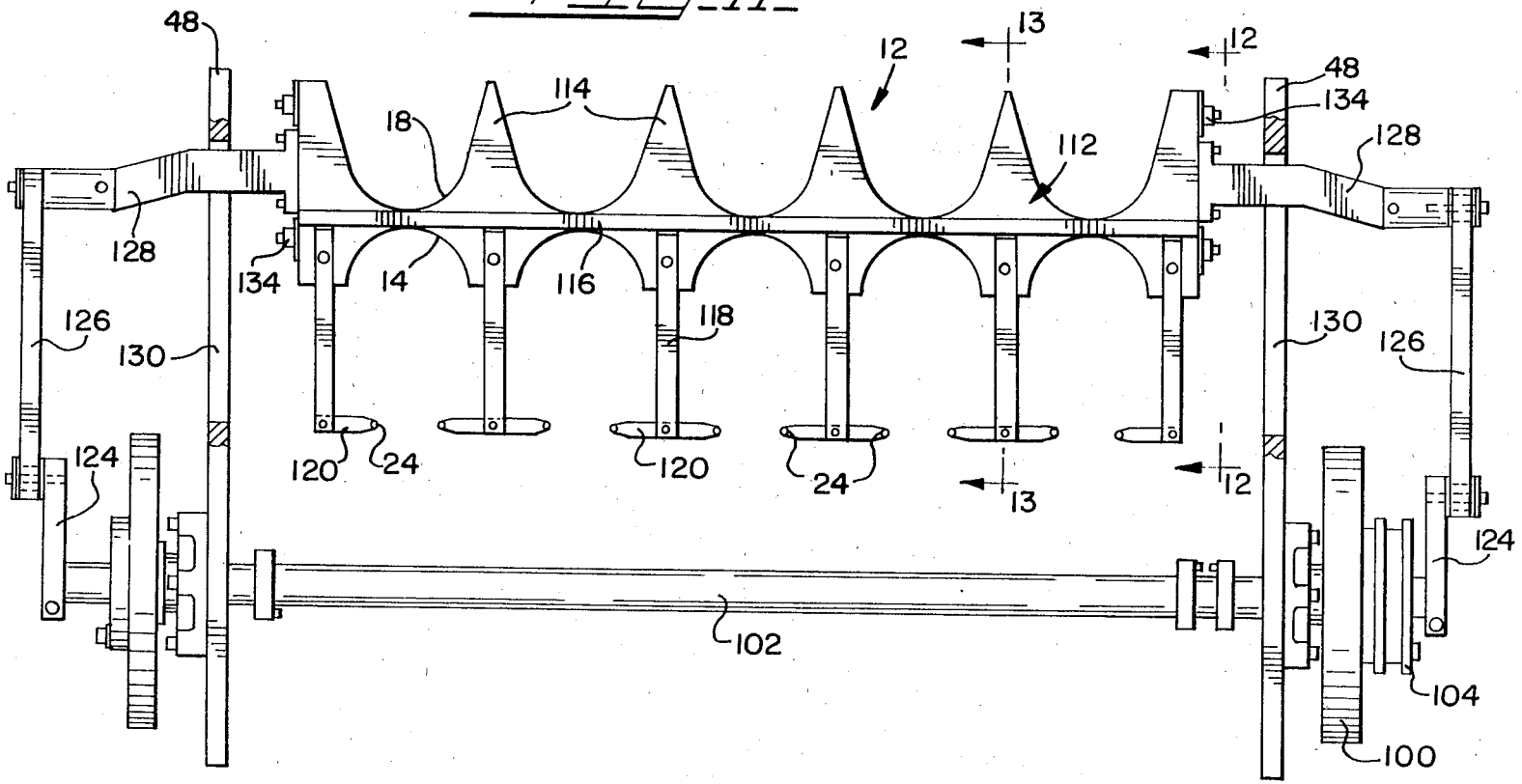
FIG. 11 is a plan view of the stack positioning member of the present invention which controls the positioning of the stacks along the stack support surface.
Figure 12:
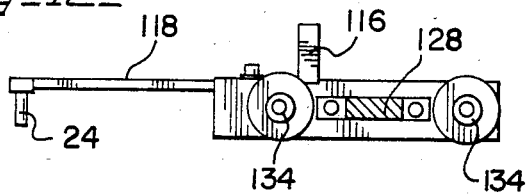
FIG. 12 is a vertical sectional view taken along line 12—12 of FIG. 11.
Figure 13:
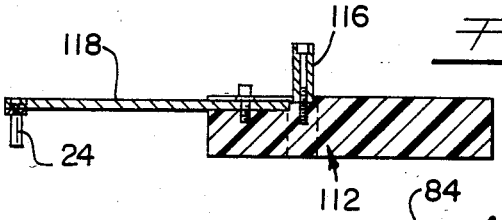
FIG. 13 is a vertical sectional view taken along line 13—13 of FIG. 11.

After the stacks are released, by retraction of guides 10, to a release position below the slide rails 6, the stack is pushed by the stack positioning member 12 into engagement with the downline stack former 16, which urges any misaligned slices within the stack into alignment. The stack positioning member 12 (see FIG. 11) is generally positioned above the elongated tapered guides 10 which form the stack catcher, and moves back and forth in a reciprocating motion over the guides, parallel to the slide rails.

Referring to FIGS. 11–14, the stack positioning member 12 has means for engaging three in-line stacks for controlling movement of the stacks toward the pedestals 8. For retarding stacks on the supply conveyor 4 and for pushing stacks against the stack former 16, the positioning member 12 has a solid plastic bar or block, generally at 112, which is shaped to define five upstream facing surfaces 18 along one side, and five stack pusher surfaces 14 along the other side, in a back-to-back relationship.

The upstream facing, stack retarding surfaces 18 are perhaps best described as scooped-out slots defined between relatively short, tapered guides 114. The closed end of each slot is curved to correspond to the shape of the slices so that the end nestingly engages the stacks and helps urge misaligned slices into alignment. Although the end of the slot in the illustrated embodiment is approximately semi-circular to correspond to circular slices, other shapes for the stack engaging surfaces could be used without departing from the present invention.

The other side of the plastic bar 112 is scalloped, forming a series of five spaced apart semicircular pusher surfaces 14, which are back-to-back with the respective retarding surfaces 18 for each stack run. To strengthen and rigidify the plastic bar 112, an aluminum support 116 is attached along the top surface.

For pushing aligned stacks beyond the stack former 16 and onto the pedestals 8, the stack positioning member 12 has a forward extending arm 118 extending from the upper surface, between each of the pusher surfaces 14. Each arm 118 terminates in a cross bar 120 mounting one or two depending pins 24 on the ends thereof. The pins are positioned such that adjacent pins of each crossbar engage the rearward edge of an aligned stack and push the stack onto the respective downline pedestal 8. The pins 24 are located sufficiently in front of the pusher surfaces 14 that the stack former 16 can return to the stack engaging position after an aligned stack is pushed past the stack former, to engate the next upstream stack being moved forward by the pusher surface.

The stack positioning member 12 is preferably mounted for reciprocal movement via rotary crank 124 mounted on drive shaft 102. The crank is attached by a connecting rod 126 to side arms 128 extending from the left and right ends of the stack positioning member through a slot 130 in each of the side plates 48. Accordingly, for each rotation of the crank 124, the stack positioning member completes one full reciprocating cycle with respect to the stack support surface.

Figure 15:
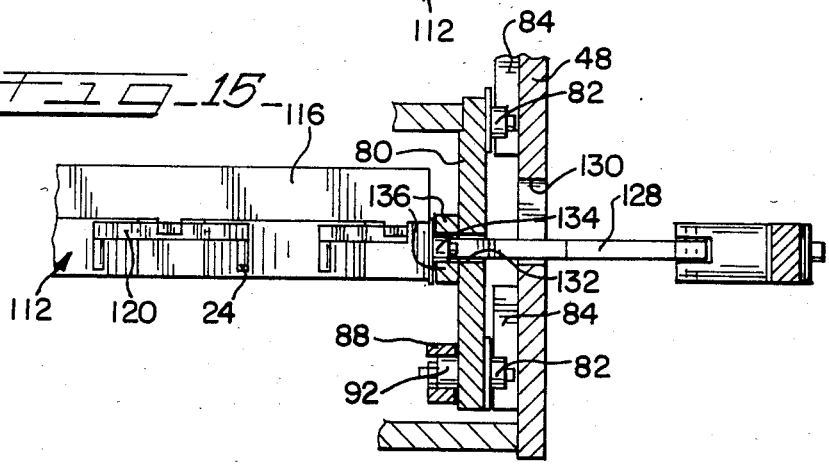
FIG. 15 is a sectional view taken aong line 15—15 of FIG. 14.
Figure 14:
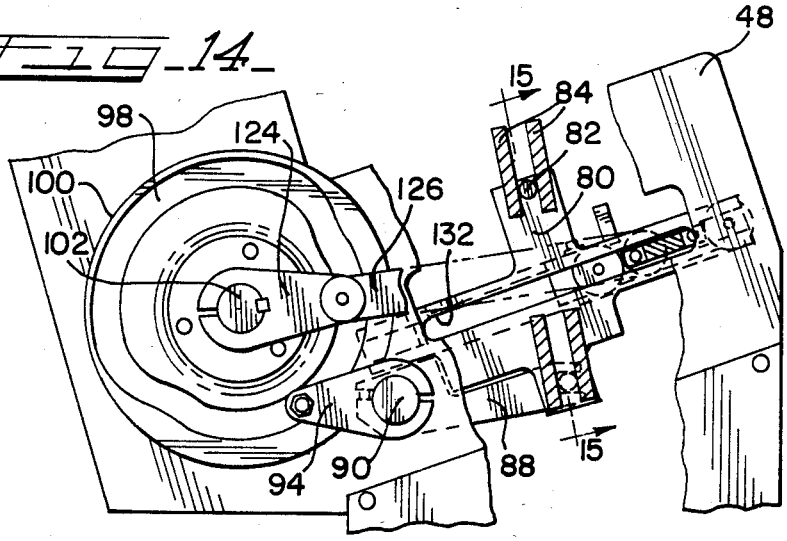
FIG. 14 is a side elevational view of the apparatus of FIG. 2, taken along line 14—14 of FIG. 2, with portions broken away to better illustrate the means for raising and lowering the stack positioning member.

As best seen in FIGS. 14 and 15, each side arm 128 of the stack positioning member 12 also extends through an elongated slot 132 in the adjacent slide lifter 80. Each end of the stack positioning member also includes rollers or followers 134 positioned within a slot defined between wear strips 136 mounted on the inside surface of each slide lifter. The slot defined by the wear strips 136 is coincident with the slot through which the slide arm passes and is substantially parallel to the slide rails 6. Accordingly, as the stack positioning member reciprocates, the side arms move back and forth within the slots 132 in the slide lifters and, thus, are simultaneously lifted or lowered by vertical movement of the slide lifters. Accordingly, the stack positioning member 12 moves up and down simultaneously with the stack catcher guides 10.

The cam track 98, which controls the raising and lowering of the slide lifter, and the rotary crank 124, are mounted on shaft 102 in the appropriate angular relationship so that the slide lifters are in a raised position during the return movement of the stack positioning member 12. This position keeps the stack positioning member raised sufficiently above the slide rails 6 and the supply conveyor 4 so as not to interfere with any stacks positioned on the rails during the return stroke. At the end of the return stroke, the slide lifters 80 are lowered, simultaneously moving the stack catcher guides 10 below the slide rails 6 to release any stack detained by the guides, while lowering the stack positioning member 12 to adjacent the slide rails. The stack positioning member can then push the previously detained stack downstream into engagement with the stack former 16 during the downstream stroke or pass caused by the rotating crank.

Figure 16:
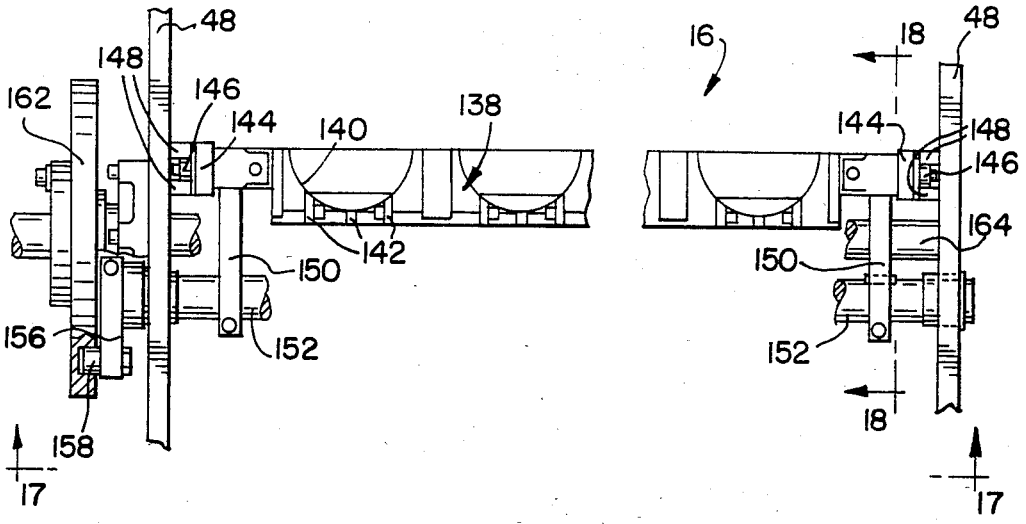
FIG. 16 is a top plan view of the stack former employed in the present invention for urging misaligned slices into alignment.
Figure 17:
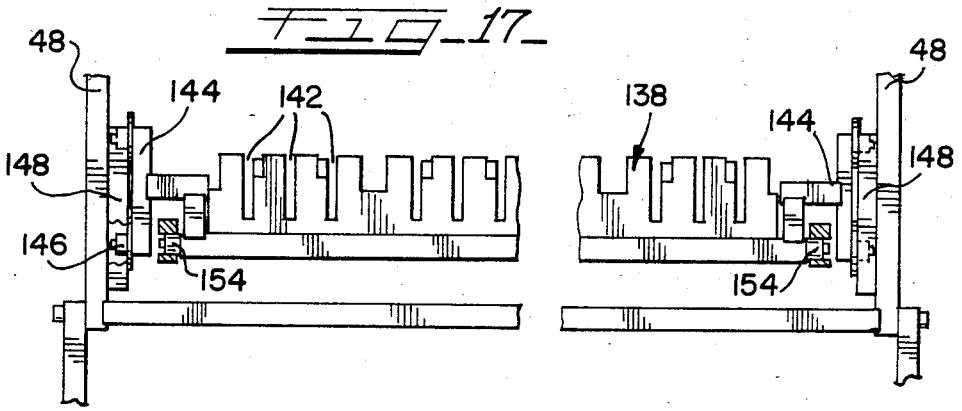
FIG. 17 is an end elevational view, taken along line 17—17 of FIG. 16.
Figure 18:
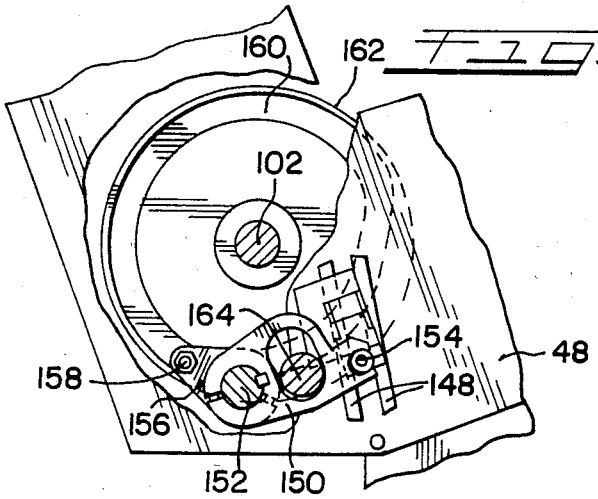
FIG. 18 is a vertical sectional view taken along line 18—18 of FIG. 16, and depicting the means by which the stack former is raised to a stack engaging position and lowered to a stack release position.

The stack former 16 which serves to urge any misaligned slices within the stack into alignment is illustrated in detail in FIGS. 16–18. Of similar shape to the stack pusher surfaces 14, the stack former comprises a rigid plastic cross-member 138, one side of which is scalloped to define five individual semicircular stacker forming surfaces 140. The plastic cross-member 138 (referring to FIG. 17) is sufficiently thick to protrude above the slide rails 6 to fully engage a stack being pushed forward by the stack positioning member 12. Three slots 142 are provided in the back wall of each stack engaging surface, through which the slide rails 6 pass without interruption, while still permitting movement of the stack former between positions above or below the rails.

Side brackets 144 on each end of the stack former cross-member 138 mount a pair of followers 146 which are received between generally vertically disposed wear plates 148 on the inside surface of the side plates 48, thereby limiting the movement of the stack former to up and down movement relative to the slide members 6. The stack former is raised or lowered by a pair of levers 150 which are mounted on each end of a pivot shaft 152 and engage a pin 154 on each end of the former. Rotation of the pivot shaft is controlled by a pivot arm 156 which mounts a cam follower 158 for following cam truck 160 in rotary cam plate 162.

The cam plate 162 is mounted on the same drive shaft 102 as is the cam plate 100, which controls the lifting of slide lifters 80, and crank 124 which reciprocates the stack positioning member 12. The cam track 160 for the stack former is in angular relationship with the rotary crank 124 and cam plate 100, so that when the stack positioning member 12 first moves along its stroke in a downstream direction, the stack former is momentarily retracted to a position below the slide rails 6. This permits the stack engaging pins 24 on the end of forward extending arm 118 of the stack positioning member to push the aligned stacks downstream onto the pedestals 8. Immediately after the aligned stack passes, the stack former returns to a stack engaging position to engage the stacks being pushed forward by the stack pusher surfaces 14 of the stack positioning member.

As best seen in FIG. 18, the pivot arm 150 includes a cut-out portion to accommodate pivot shaft 164 which, as will be described next, controls the movement of the pedestals 8 between up and down positions.

Turning now to FIGS. 19–21 which depict the pedestals 8 and related apparatus, the pedestals 8 are generally circular in shape and are mounted atop a cross bar 166 which extends the side plates 48 of the apparatus. End brackets 168 on the cross bar mount a pair of rollers 170 which are received within a substantially vertical slot defined between wear plates 172 on the inside surface of the side plates 48.

The pedestals are moved up and down by a pair of levers 174. Each lever is slotted at one end to receive a pin or follower 176 attached to the respective end bracket 168, and attached at the other end to the pivot shaft 164. The levers 174 each have a large cut-out portion to receive and accommodate the pivot shaft 152 which controls movement of the stack former. The pivot shaft 164 is turned by a pivot arm 178 which is attached to the shaft and has a cam follower 180 received within a cam track defined on the inside surface of rotary cam plate 184, which is mounted on the master drive shaft 102. When rotating, the cam plate causes the pivot arm to turn the shaft 164 which, in turn, via levers 174, raises or lowers the pedestals 8.

In the lowered position, the pedestals 8 are substantially coplanar with the upper stack supporting edge of the slide rails 6, so that the stacks may move directly from the slide rails onto the pedestals. The movement of the pedestals to the upper position is for the purpose of inserting the stacks between the spread pickup and guide fingers 26 and 28 of the gripper assemblies 24, which load the stacks into the close fitting cavities of a container. Accordingly, cam plate 184 is positioned on the drive shaft 102 so that the pedestals are in the lowered position when the stack positioning member 12 is moving toward the pedestals to receive aligned stacks from the stack former 16. After the positioning member retracts to a position out of the way, and the gripper assembly is positioned over the pedestal, the pedestal is first raised to insert the stack between the pick-up fingers of the griper assembly and then lowered only after the fingers have closed around the stack.

Referring back to FIGS. 3–6, the gripper assemblies 26 are pivotally mounted above the pedestals 8, for movement between a pickup position located directly above the pedestals and a loading position located above the cavities 20.

As best seen in FIG. 4, upper shaft 186 is driven indirectly by motor 68 through drive chain 188 which connects upper sprocket 190 with an intermediate sprocket 192 mounted on the shaft 102. Again, the sprockets 190 and 192 are preferably of the same size and with the same number of teeth, so that one revolution of the shaft 102 corresponds to one revolution of the upper shaft 186.

Figure 6:
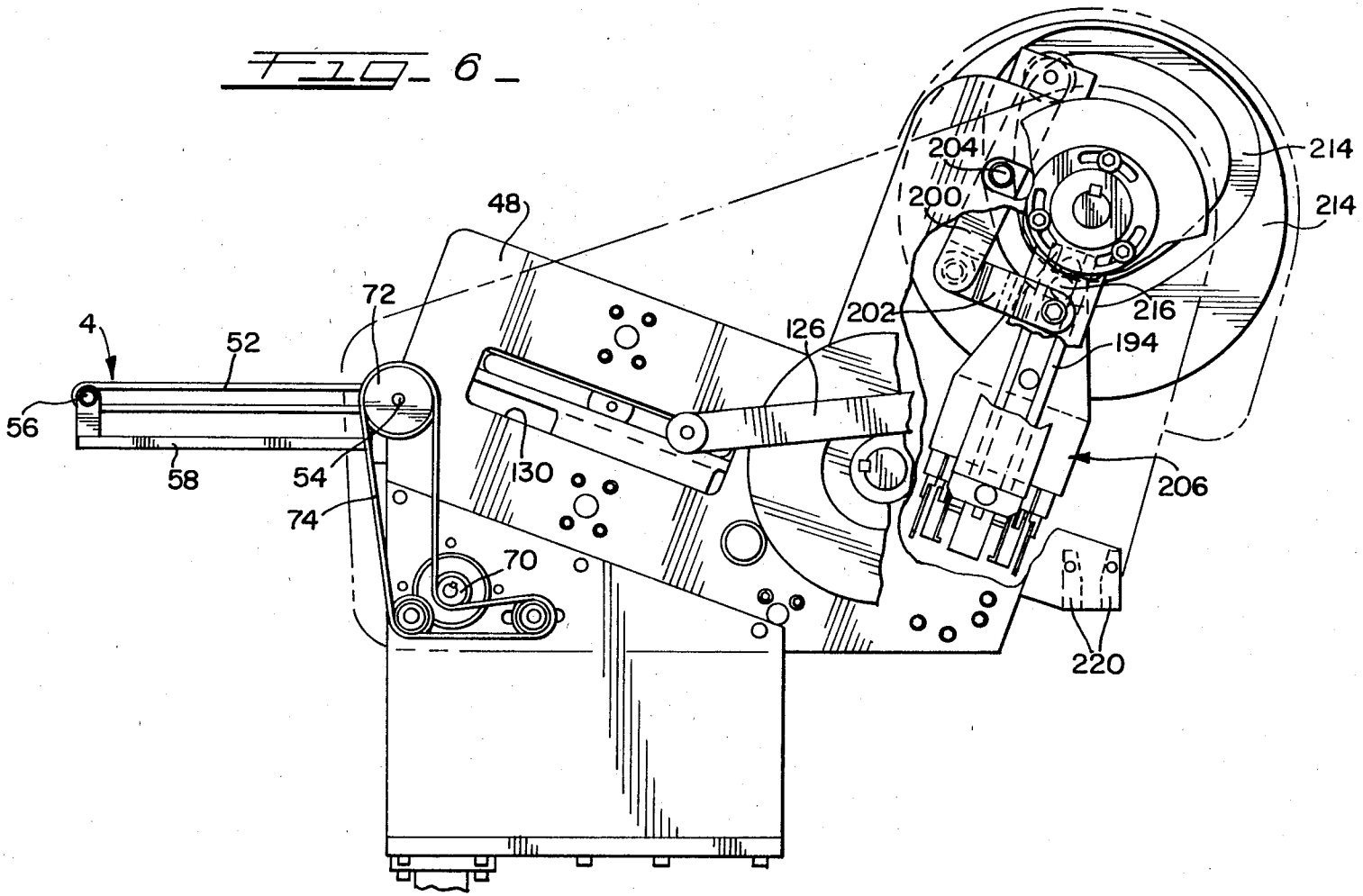
FIG. 6 is similar to that of FIG. 5, but depicts the stack gripper assembly pivoted to the stack pick-up position.
Figure 7:
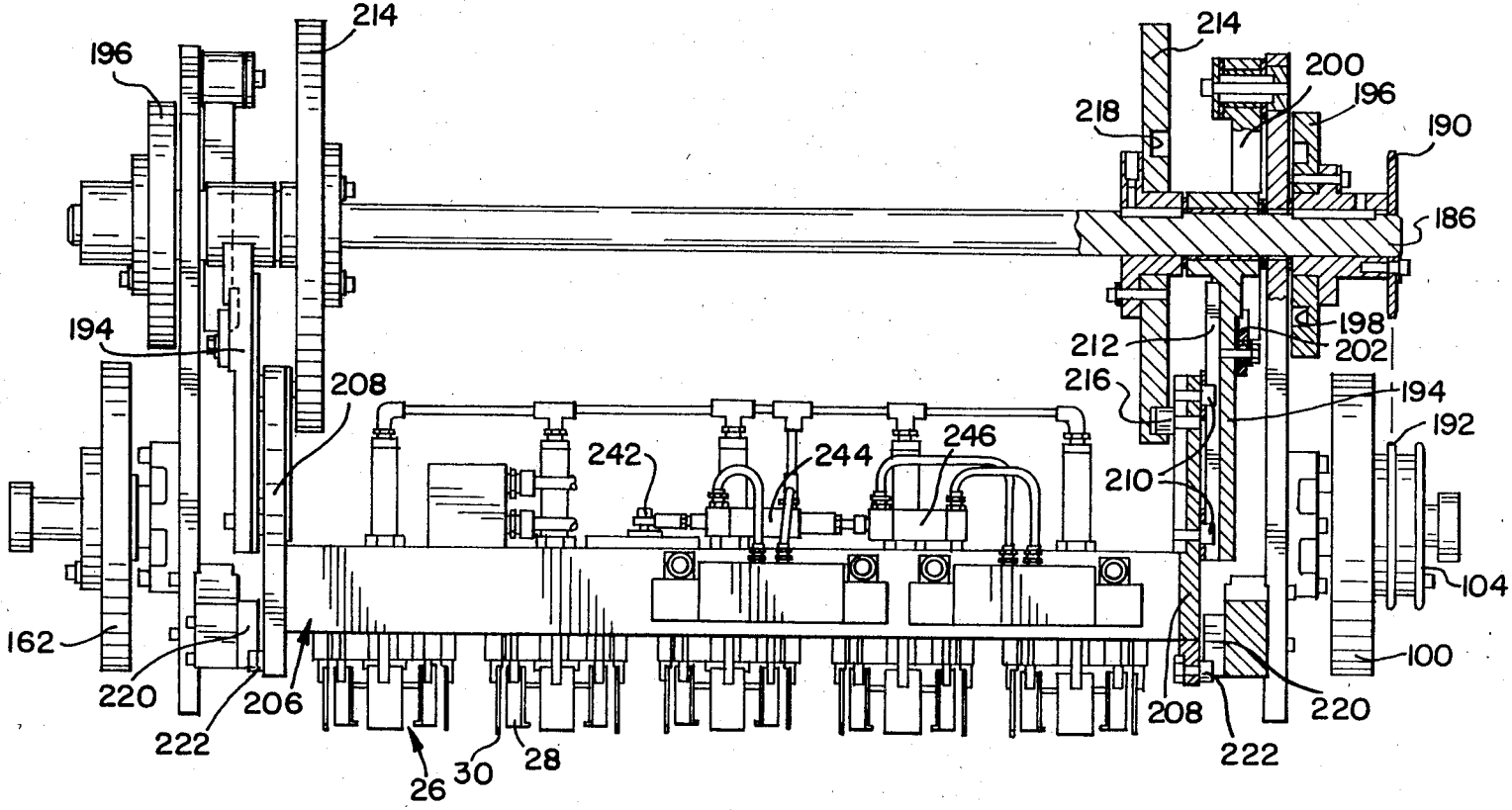
FIG. 7 is an end elevational view, partially in section, of the gripper assembly of FIG. 1, taken along line 7—7 of FIG. 1, and depicting the means for moving the gripper assembly.

The mechanism by which the rotation of upper shaft 186 is converted to a pivoting action of the gripper assembly 26 is best seen in FIG. 5–7. The pivotong movement of the gripper assemblies is generally controlled by a pair of swing arms 194 which are mounted on opposite sides of the upper shaft 186 and freely rotatable with respect to the upper shaft. Also mounted on the upper shaft 186 is a cam plate 196 which has a cam track 198 defined along the inside surface. The cam plate is mounted substantially flush with the outside surface of the side plate 48.

The following description of the operation of one swing arm applies equally to the other swing arm. The swing arm 194 is actually pivoted by a pair of connecting links 200 and 202, the movement of these links being controlled by the cam plate 196. As perhaps best seen in FIG. 5, one end of connecting link 200 is pivotally mounted at the upper edge of the side plate 48. The other end of the connecting link 200 is pivotally attached to connecting link 202, and the other end of connecting link 202 is pivotally attached to the swing arm 194. The connecting link 200 has a cam follower 204 which extends through an access opening in the side plate 48 and into the cam track 198. Rotation of the cam plate 196 causes link 200 to pivot which, in turn, via connecting link 202, pivots the swing arm 194.

In the illustrated embodiment, the present invention comprises a plurality (five) of gripper assemblies 26 in side by side relationship for simultaneous operation on five stacks. Referring to FIG. 7, the gripper assemblies are mounted side by side in a horizontal support housing 206. A bracket 208 at each end of the housing 206 has a pair of followers or rollers 210 slidably positioned within a vertical slot 212 in the swing arm 194. Accordingly, as the swing arm pivots, the housing 206 is carried with the arm. As noted briefly earlier, when positioned over the container, the gripper assemblies move downwardly to cause at least partial insertion of guide fingers 30 into the close-fitting cavity 20 of the container 22.

Vertical movement of the gripper assemblies is controled by a pair of rotary cam plates 214 which are fixedly attached to the upper drive shaft 186. A cam follower 216 mounted on each housing end bracket 208 is positioned within cam track 218 in each cam plate 214 so that rotation of the cam plates causes sliding movement of the bracket along the slots 212 in the swing arms 194. Thus, as the swing arm is pivoted, rotation of the cam plates 214 simultaneously causes a raising or lowering of the gripper assembly.

The cam track 218 is designed to maintain the gripper assemblies 26 in a raised position except when the assemblies are located over the container 22 into which the stacks are to be inserted. At that time, the gripper assembly is momentarily lowered until the stack is inserted into the cavity 20, after which the gripper assembly is raised and remains in the raised position until the assembly again returns over the container. At the loading station, raising of the pedestals inserts the stacks between the pickup fingers.

To precisely control the location of the gripper assemblies 26 with respect to the container 22, a lower pair of wear strips 220 (FIG. 5) is attached to the inside surface of the side plates 48 and define a vertical slot between the strips. The end brackets 208 of the gripper assemblies have a lower follower 222 which slides between the wear plates only when the gripper assemblies are lowered for insertion of the stacks into the container. In FIG. 5 the slot defined between the wear strips 220 is wider at the top to overcome any small amount of play or variation in the position of the stack gripper assembly housing when the assembly is positioned over the container. The pivoted positioning of the stack gripper assemblies in the pickup position is illustrated in FIG. 6.

In FIG. 7, the overall gripping assembly consists of five stack gripper assemblies 26 in an in-line, side-by-side relationship. Each gripper assembly depends from the horizontal housing 206 which extends between the end brackets 208.

Referring to FIGS. 22–25 for more detailed drawings of the construction and operation of each gripper assembly, the pickup and guide fingers 28 and 30 are spaced alternately in a generally circular configuration, corresponding to the shape of the stack which is to be picked up. Each finger has a lower stack engaging portion which is relatively wide and flat, and an upper shank which is pivotally attached below the upper end of the shank to a finger support plate 224 which is carried on the underside of bottom plate 226 of housing 206. The upper ends of each finger terminate in a reduced diameter portion which has a spherical grommet 236 received over the portion and forming a cam-follower for cooperation with cam plate 32. The finger support plate 224 is secured to the underside of the housing by threaded engagement between retaining nut 228 and hollow shank 230. The shank includes an enlarged diameter portion captured between the bottom plate 226 and the top plate 232 of the housing 206. Alignment pin 234 between the finger support plate and the bottom plate assures that the fingers are in proper angular position for operation by the cam plate 32.

Movement of the pickup and guide fingers 20 and 30 is controlled by rotary cam plate 32 mounted on the shank 230 within the housing 206. The upper ends of the pickup and guide fingers extend through the bottom plate 226 of the housing and into cam track 34 in the underside of the cam plate 32, whereby rotation of the cam controls the spreading or closing of the pickup and guide fingers.

The configuration of the cam track (shown in FIG. 25) permits selective control of the spreading or closing of the pickup and guide fingers by incremental rotation of the cam plate. As seen in FIG. 5, the cam track pattern is repeated every 90°. Cam follower 236 is on the upper end of one of the adjacent pickup fingers 28. In the position shown in solid, both cam followers are positioned at their innermost locations from the edge of the cam plate and, accordingly, both the pickup finger and guide fingers are pivoted to a spread similar to that shown in FIG. 23.

Figure 22:
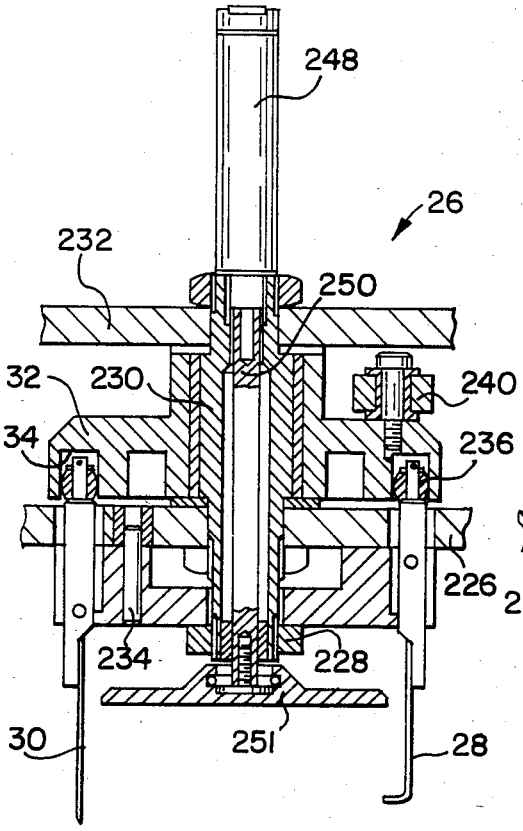
FIG. 22 is a vertical sectional view of one of the stack gripper assemblies, taken along line 22—22 of FIG. 24, and depicting the gripping and guide fingers in a closed position.

Rotation of the cam plate 15° counterclockwise moves both cam followers to the edge of the cam plate, causing both the guide finger and pickup finger to pivot to a closed position as depicted in FIG. 22. A further rotation of cam plate 15° permits the guide finger to remain in the closed position while the cam follower of the pickup finger is moved inwardly, causing the pickup finger to pivot to the spread position.

This selective opening and closing of the guide and pickup fingers is useful because, in the pickup position, both pickup and guide fingers are spread so that the pedestals 8 can insert a stack between the fingers. The cam plate is then rotated 15°, closing both pickup and guide fingers against the stack. The inwardly turned end of the pickup finger supports the stack in this position. After moving to the container, the gripper assembly moves downwardly so that the end of the guide fingers, which are longer than the pickup fingers, extends partially into the close-fitting cavity 20 of the container 22. The pickup fingers do not extend downwardly into the container but stop short of the top edge. Upon further rotation of the cam plate, the pickup fingers are caused to pivot to an open position to release the stack, while the guide fingers are retained in a closed position to guide the stack into the cavity.

The rotation of the cam plate 32 is controlled by a connecting link 24 which is pivotally attached to each cam plate of each gripper assembly 26 in the housing 206. The connecting link has an upstanding arm 24 (FIG. 7) extending through the top plate 232 of the housing. This arm is engaged by a double-action arrangement of air cylinders 244 and 246. The arm is attached to a shaft of air cylinder 244 which is, in turn, attached to the shaft of air cylinder 246. Actuation of air cylinder 244 moves the link sufficiently to pivot all the cam plates 15°. Actuation of air cylinder 246 causes movement of the link an additional 15°. Retraction of both cylinders returns the cam plates to their original position.

To assist in inserting stacks into the container cavities 20, ejection means are provided in association with each gripper assembly 26 for actually ejecting the stack from between the fingers. Referring to FIG. 22, the ejection means comprises an air or hydraulic cylinder 248 mounted above the top plate 232 of the housing 206, with a shaft 250 extending downwardly through the hollow shank 230. A generally flat circular ejector plate 251 is attached at the end of shaft 250. Upon actuation of the cylinder 248, the shaft drives the ejection plate downwardly, forcing the stack quickly into the container cavity. Of course, the ejection operation is timed to occur after the pickup fingers 28 are spread to a release position.

Figure 26A:
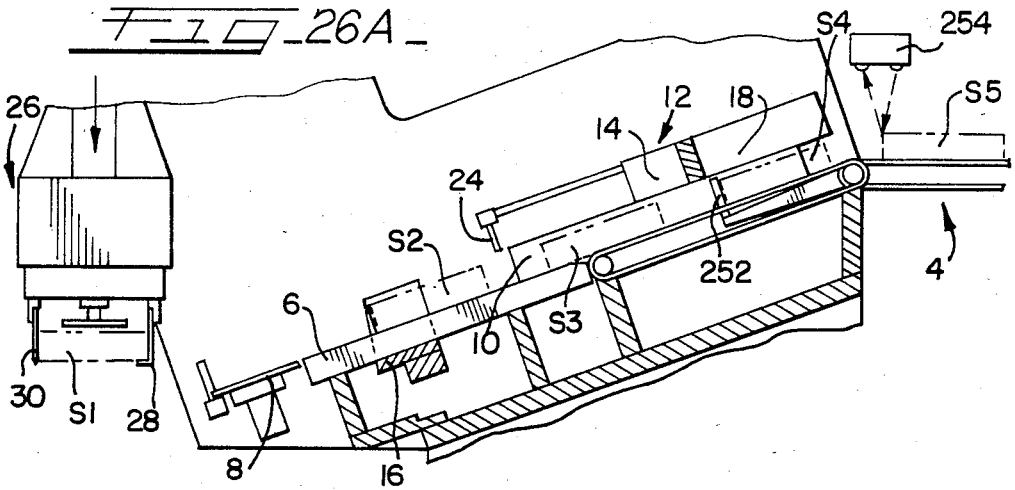

FIGS. 26*a–e* show an overall operation cycle of the present invention. Although FIGS. 26*a–e* depict the operations being performed on a single in-line series of stacks, the same operations are occurring simultaneously on four other in-line series of stacks. The stacks are shown in dashed lines. FIG. 26*a* depicts the stack positioning member 12 at the end of the return stroke, still in a lifted position, as are the elongated tapered guides 10. An upstream stop 252 holds stacks on the upstream end portion of the inclined supply conveyor 4. Such a stop is pivotally mounted for movement between the position depicted in 26*a* to retain a stack on the upstream supply conveyor and a retracted position (26*b*) below the supply conveyor for releasing the stack.

When stacks are first being supplied, i.e., at the beginning of a production run, the stop 252 is in a retracted position, permitting stacks to pass immediately along the supply conveyor into engagement with the elongated tapered guides 10. As noted earlier, the diverting conveyor 32 supplies stacks in sequence to each conveyor run. After five stacks are provided to engage the guides 10 of each conveyor run, sensing of the next stack by photoelectric eye 254 causes the stop member 252 to move to the stack engaging position shown in FIG. 26*a* to hold back the next stack from interference with operations downstream. FIG. 26*a* depicts the present invention during a portion of the continuous operation of the equipment, and not at the startup.

At the cycle position in FIG. 26*a*, a stack S1 (in which the slices are aligned) has been picked up by the stack gripper assembly 26 which has been pivoted to a position above the container into which the stack will be loaded, and is moving vertically downward to insert the stack into the container. Stack S2 is in nesting engagement with stack former 16, which is in a raised stack-engaging position. The next upstream stack S3 rests on the upstream end of the slide rails 6, and the stack catcher guides 10 prevent further downstream movement of that stack. And yet a further upstream stack S4 is being held back by the stop member 252. The cycle is started upon sensing by the electric eye 254 of the next in-line stack, behind the one retained by the stop member 252.

Figure 26B:
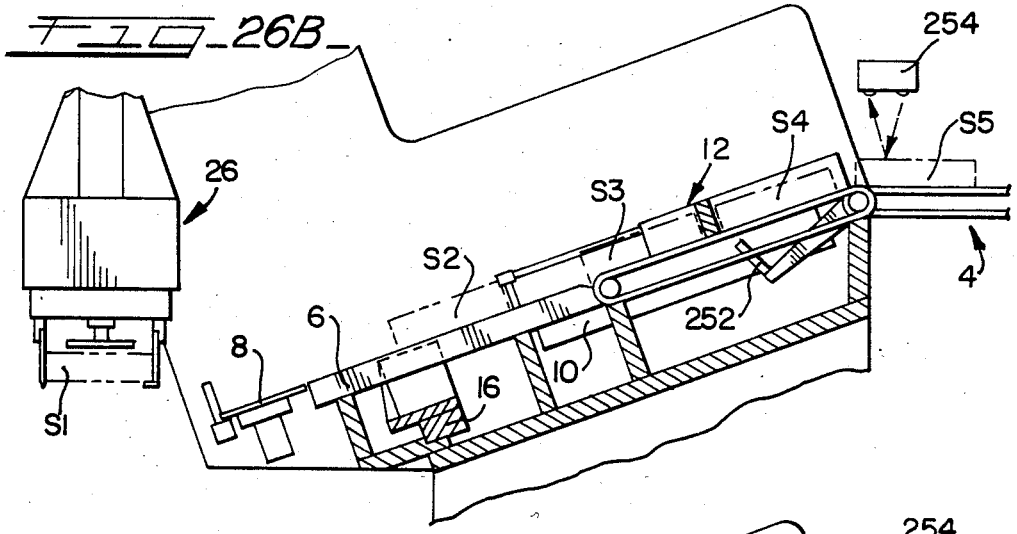

In the position shown in FIG. 26*b*, which is approximately one-tenth of the way through the cycle, the stack positioning member 12 has been lowered by the lifter to adjacent the upper surface of the slide rails 6 and the inclined portion of supply conveyor 4. Simultaneously, the elongated tapered guides 10 have been moved to a stack release position below the conveyor rails, whereby releasing stack S3 for further movement downstrea. Stack former 16 has also been moved to a stack release position to permit the aligned stack S2 to be pushed further downstream onto pedestal 8. At this point, the gripper has moved downstream into the cavity, and is about to eject the stack S1 into the cavity. The upstream most stack S4 has been released by stop member 252.

Figure 26C:
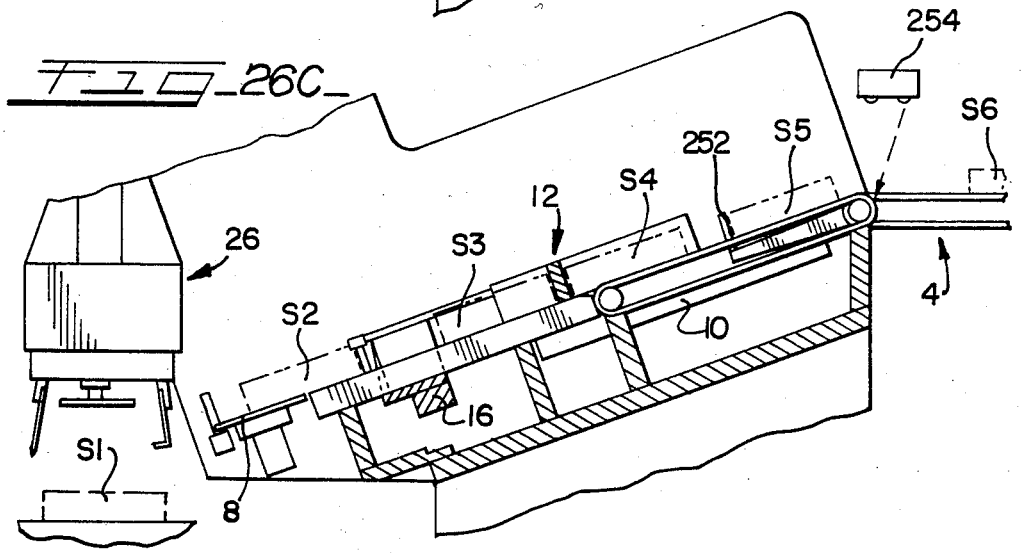

FIG. 26*c* shows the stack positioning member 12 having moved partially through its downstream stroke. The aligned stack S2 is being pushed onto the pedestal 8 by stack engaging pins 24, and the stack former 16 has returned to the stack engaging position to engage the stack S3 being pushed forward by pusher surface 14 of the stack positioning member. Simultaneously, the upstream stack S4 which was released by the stop member 252 has abutted against upstream surface 18 of the stack positioning member, which retards movement of stack S4 by the upstream conveyor which is moving faster than the stack positioning member. The stop member 252 has returned to the stack engaging position to hold the next stack 25 on the upstream end of the supply conveyor. Also in FIG. 26*c*, the stack gripping assembly 26 has deposited the stack S1 into the container cavity 20, retracted to a raised position, and is about to swing to the load position for receiving another stack. In this position, all the fingers, both pickup and guide 28 and 30, are in an open, spread position.

Figure 26D:
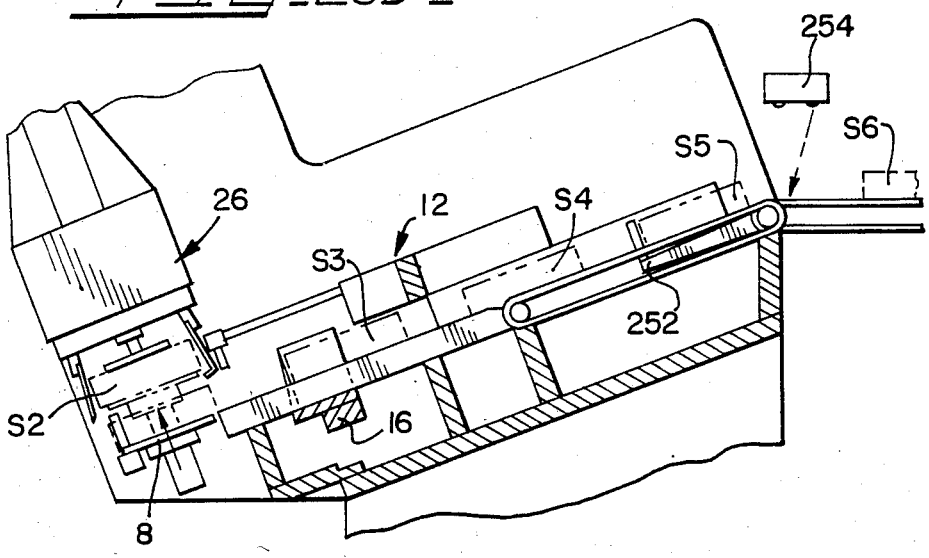

In FIG. 26*d*, the aligned stack S2 has been pushed onto the pedestal 8, and the pedestal is moving upwardly to insert the stack between the spread guide and pickup fingers of the gripper assembly. The previously detained stack S3 has been forced into engagement with the stack former 16 and the stack positioning member 12. The elongated guides 10 are in a raised position, and the stack positioning member is beginning to return to its start position. The elongated guides block any further downstream movement of stack S3 at this time.

Figure 26E:
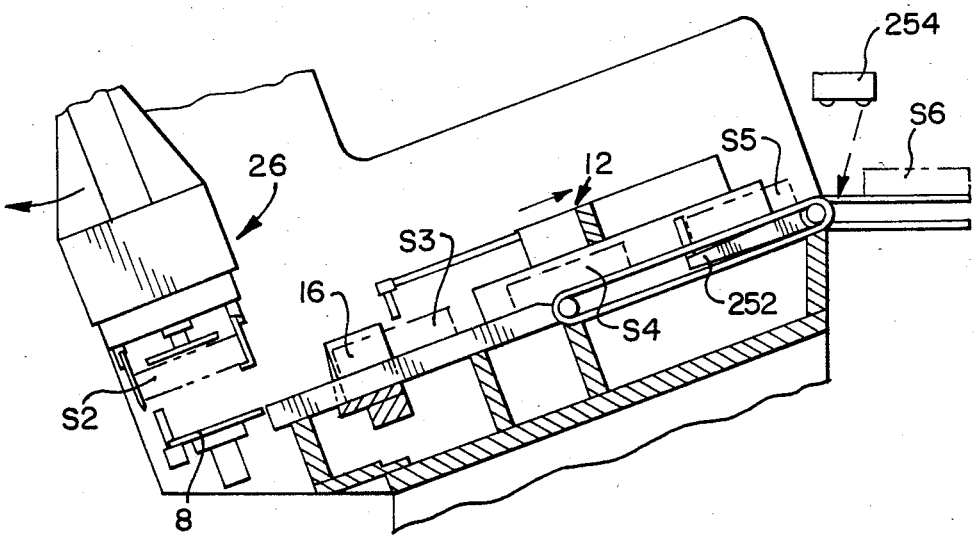

Finally, in FIG. 26*e*, the stack positioning member 12 has returned further along its return stroke. The stack gripper assembly 26 has closed about the stack S2, and the pedestal 8 has returned to its lower position which is substantially coplanar with the top edge of the slide rail 6. The stack gripper assembly is beginning to pivot to the position for depositing the stack into one of the container cavities. The stacks S3, S4 and S5 remain in the same positions described in FIG. 26*d*. Upstream on the horizontal portion of the supply conveyor, the nextmost upstream stack S6 is approaching the electric eye 254 which will energize the apparatus for repetition of the cycle just described.

Although described in terms of a preferred embodiment, this invention can be embodied in various forms and, therefore, is to be construed and limited only by the scope of the appended claims.

We claim:

1. An apparatus for aligning the slices in stacks of sliced food products to permit insertion of the stacks into container cavities, the apparatus comprising:

a stack support surface disposed to receive stacks from an upstream stack supply conveyor;

means to detain a stack received from the supply conveyor on the upstream end portion of the support surface;

a stack former downstream of the detaining means and movable between a stack engaging position and a stack release position, the stack former having a stack engaging surface disposed to engage the front edge portion of a stack to urge any misaligned slices into alignment;

a stack positioning member movable along the stack support surface to engage a rearward edge portion of the detained stack to push the stack into engagement with the stack former while simultaneously engaging a front edge portion of an upstream stack on the supply conveyor to retard its movement of the upstream stack onto the support surface wherein the stack positioning member is mounted for repeated movement along the support surface and wherein the stack positioning member is mounted for reciprocal movement with respect to the stack support surface and includes means to move the stack positioning member to engage stacks on the support surface during movement downstream, and the stack positioning member is spaced above the stacks during return movement upstream, and a lifter means for lifting the stack positioning member to the raised position above the stack support surface during the return movement of the stack positioning member and to lower the stack positioning member to a stack-engaging position during movement downstream wherein the detaining means comprises a stack catcher carried by the lifter means for movement between a raised stack-detaining position above the stack support surface and a lower stack-release position below the support surface, the stack catcher being raised and lowered by the lifter synchronously with the raising and lowering of the stack positioning member.

2. An apparatus in accordance with claim 1, wherein the stack positioning member includes means for simultaneously pushing an aligned stack past the stack former to a further downstream position.

3. An apparatus in accordance with claim 2, wherein the further downstream station is a stack loading station.

4. An apparatus in accordance with claim 1, wherein the stacks are detained on the upstream end portion of the support surface by friction between the support surface and the stack.

5. An apparatus in accordance with claim 1, wherein the detaining means comprises a stack catcher movable between a stack engaging position to detain a stack on the upstream end portion of the support surface, and a stack release position to permit movement of the detained stack by the stack positioning member.

6. An apparatus in accordance with claim 1, wherein the stack support surface is downwardly inclined.

7. An apparatus in accordance with claim 1, further comprising a stop member movable to engage and release a stack on the supply conveyor in timed relationship with the movement of the stack positioning member.

8. An apparatus in accordance with claim 1, wherein the stack positioning member includes a stack pusher surface for engaging the rearward edge portion of the detained stack to push the stack against the stack former, and wherein the stack pusher surface is shaped to urge any misaligned slices into alignment.

9. An apparatus in accordance with claim 8, wherein the stack engaging surface of the stack former and the stack pusher surface of the stack positioning member are shaped to correspond at least in part to the shape of the slices.

10. An apparatus in accordance with claim 9, wherein this engaging surface and the pusher surface are each approximately semicircular for aligning round slices.

11. An apparatus in accordance with claim 1, further comprising a rotary mounted crank operatively connected to the stack positioning member to reciprocate such member.

12. An apparatus in accordance with claim 1, wherein the stack support surface is sufficiently wide to support a plurality of rows of in-line stacks.

13. An apparatus in accordance with claim 12, wherein the upstream conveyor has a plurality of runs for conveying the plurality of rows of in-line stacks.

14. An apparatus in accordance with claim 1, wherein the upstream conveyor comprises a plurality of individual endless conveyor bands.

15. An apparatus in accordance with claim 1, wherein the stack support surface comprises a plurality of spaced-apart rails.

16. An apparatus in accordance with claim 3, wherein the loading station comprises a pedestal disposed to receive a stack from the stack support surface.

17. An apparatus in accordance with claim 16, wherein the pedestal is movable between a raised position above the support surface and a lowered position substantially co-planar with the support surface.

18. An apparatus in accordance with claim 1, wherein the stack positioning member includes an upstream facing stack engaging surface shaped to receive the upstream stack in a nesting relationship so as to aid in alignment of slices in the stack.

19. An apparatus in accordance with claim 8, wherein the stack positioning member further comprises a pair of depending stack engaging pins downstream of the pusher surface to engage the rearward edge of an aligned stack to push the stack to a further downstream station beyond the stack former.

20. An apparatus in accordance with claim 19, wherein the stack former is operable in timed relationship to the movement of the stack positioning member to move to the release position for a sufficient period of time to permit the aligned stack to be moved downstream by the stack positioning member, and then to move to the stack engaging position to engage the next most stack being moved forward by the stack positioning member.

21. A method for aligning the slices in stacks of sliced food products to permit insertion of the stacks into container cavities, the method comprising:

supplying a plurality of stacks on a supply conveyor;

positioning each stack onto the upstream end portion of a stack support surface;

simultaneously moving a stack from the upstream end portion against a downstream stack former to align the slices while retarding movement of the next upstream stack onto the upstream end portion of the stack support surface; and pushing an aligned stack past the stack former to a further downstream position at the same time as an upstream stack is moved toward the stack former, wherein the steps of simultaneously pushing an aligned stack further downstream, moving a stack from the upstream end portion of the support surface against the stack former and retarding movement of the next upstream stack are carried out by a stack positioning member movable between the upstream end portion of the support surface and the stack former, wherein the further downstream position is a stack loading station which is operable between an actuated position to discharge each stack for insertion into a container cavity and a return position for receipt of the next stack in timed relationship with the stack positioning member, and wherein the stack loading station comprises a stack supporting pedestal movable between a raised position to discharge a stack and a lower position substantially co-planar with the support surface for receiving the next aligned stack.

22. A method in accordance with claim 21, further comprising the step of repeatedly moving the stack positioning member between the upper end portion of the support surface and the stack former to form a series of aligned stacks suitable for insertion into container cavities.

23. A method in accordance with claim 21, further comprising detaining each stack on the upstream end portion of the support surface with a stack catcher which is movable to engage and release the stack in timed relationship with movement of the stack positioning member.

24. A method in accordance with claim 21, wherein the steps are simultaneously performed on a plurality of stacks in side by side relationship.

25. An apparatus for aligning the slices in stacks of sliced food products to permit insertion of the stacks into container cavities, the apparatus comprising:

a stack support surface disposed to receive stacks from an upstream stack supply conveyor;

means to detain a stack received from the supply conveyor on the upstream end portion of the support surface;

a stack former downstream of the detaining means and movable between a stack engaging position and a stack release position, the stack former having a stack engaging surface disposed to engage the front edge portion of a stack to urge any misaligned slices into alignment; and a stack positioning member movable along the stack support surface to engage a rearward edge portion of the detained stack to push the stack into engagement with the stack former while simultaneously engaging a front edge portion of an upstream stack on the supply conveyor to retard its movement of the upstream stack onto the support surface wherein the stack positioning member includes means for simultaneously pushing an aligned stack past the stack former to a further downstream position wherein the further downstream station is a stack loading station and wherein the loading station comprises a pedestal disposed to receive a stack from the stack support surface.

26. An apparatus in accordance with claim 25, wherein the pedestal is movable between a raised position above the support surface and a lowered position substantially co-planar with the support surface.

* * * * *